US005167182A

United States Patent [19]

Sims

[11] Patent Number: 5,167,182

[45] Date of Patent: Dec. 1, 1992

[54] MODULAR FLUID ACTUATOR

[76] Inventor: James O. Sims, 1100 Brooks St., Decatur, Ala. 35601

[21] Appl. No.: 770,917

[22] Filed: Oct. 4, 1991

[51] Int. Cl.[5] ..... F01B 29/04

[52] U.S. Cl. ..... 92/59; 92/128; 92/169.1; 92/171.1

[58] Field of Search ..... 92/59, 128, 169.1, 169.2, 92/171.1

[56] References Cited

U.S. PATENT DOCUMENTS

| | | | |
|---|---|---|---|
| 37,195 | 12/1862 | Fitzgerald | 92/169.1 |
| 494,118 | 3/1893 | Brown | 92/169.1 |
| 2,235,070 | 3/1941 | Giern et al. | 92/169.1 |
| 2,854,952 | 10/1958 | Wilson | 92/169.1 |
| 3,288,036 | 11/1926 | Fisher | 92/151 |
| 4,773,306 | 9/1988 | Dirkin | 92/151 |
| 5,016,522 | 5/1991 | Allardin | 92/151 |

FOREIGN PATENT DOCUMENTS

| | | | |
|---|---|---|---|
| 0142110 | 11/1980 | Japan | 92/128 |
| 0016738 | 1/1983 | Japan | 92/128 |

*Primary Examiner*—Thomas E. Denion
*Attorney, Agent, or Firm*—Phillips & Beumer

[57] ABSTRACT

A fluid actuator assembly comprising a plurality of modules which are secured in serial relation to form the body of the fluid actuator. A replaceable liner, common to each of the modules, extends through the bores of the modules which make up the body. Means are provided to secure the modules in serial relation.

17 Claims, 5 Drawing Sheets

MODULAR FLUID ACTUATOR

FIELD OF THE INVENTION

This invention relates generally to fluid actuators having a liner in the bore thereof which serves as a bearing surface for a piston reciprocally mounted in the bore. More particularly, this invention relates to such an actuator which is constructed in a modular configuration.

BACKGROUND OF THE INVENTION

Typically, fluid actuator cylinders are provided with a wall thickness which is sufficient to withstand the internal operational pressures and a bore of predetermined diameter which is precision machined to permit a piston to smoothly reciprocate therein. During use, the walls of the bore may become worn and pitted, thus presenting a rough surface for the piston and piston seals to slide on. The worn and pitted surfaces may cause severe damage to the piston and seals, resulting in severe leakage of fluid from the cylinder, causing unsafe shutdown of the system in which the actuators are used.

Once the inner walls of the cylinder bore have been pitted or worn and leakage occurs, it is necessary to shut down the system in which the actuator is being used and to replace or repair the worn actuator. Typically, when replacing the defective actuator, it is required to order and await delivery and installation of the new actuator. This is usually a time-consuming process which results in excessive "down time" of the entire system.

Alternately, the entire actuator is removed from the system and repaired by reboring and honing the damaged bore and replacing the piston with an oversized piston. This procedure is costly and time-consuming. Another manner in which the actuator body is typically repaired is by removing the existing piston, reboring the damaged walls of the bore, and installing a liner in the rebored actuator body. The internal diameter of the liner must be sized to accommodate the diameter of the piston to be installed. In most instances, the wall thickness of the liner must be such as to make the internal diameter of the actuator body the same as it was before the reboring process. This process is time-consuming and expensive.

Furthermore, boring very large actuator bodies presents a multitude of other problems. For example, special apparatus must be used in handling very large cylindrical bodies (for example, cylindrical bodies approximately 10 feet long and 3 feet in diameter and having a substantial wall thickness). Such structures are usually very heavy and cumbersome, and boring such structures is virtually impossible in a typical machine shop.

Applicant proposes to eliminate such problems by manufacturing actuator bodies in a modular configuration which eliminates the costly and time-consuming repair or replacement procedures discussed above. To this end, the actuator of the present invention includes a plurality of actuator bodies (or modules) which are secured together in serial relation with a single cylindrical liner common to and mounted in each of the modules. The modules are adapted for assembled relation to achieve the desired length necessary to accommodate the piston stroke. The modules are manufactured with various lengths and bore diameters as well as wall thicknesses.

The material of which the actuator body and liner is made is chosen for the particular application of the actuator assembly. For example, if a lightweight actuator assembly is required, the actuator body may be made of aluminum magnesium or other lightweight material. The liner is chosen to be compatible with the medium which is used in the system.

Aluminum, for example, is very useful in systems which have weight restrictions; however, aluminum liners may not be compatible in an emulsion environment having a high percentage of water. Steel is useful as a liner in general service. Bronze may be used for general water service conditions. Stainless steel has application in corrosive environments, and electrodeless nickel is applicable in clean water environments. Plastic liners or plastic-coated liners may be useful in various environments.

Some prior art patents exist which disclose the use of sleeves in internal combustion engines. U.S. Pat. No. 2,324,547, issued to Wagner on Jul. 20, 1943, discloses a liner for a cylinder of an internal combustion engine and method of lining the engine cylinder. U.S. Pat. No. 1,321,792, issued to Jackson on Nov. 11, 1919, also discloses a sleeve for cylinders of an internal combustion engine. The sleeve further includes circumferential passages or grooves on its external surface for circulating coolant between the sleeve and the internal surface of the cylinder bore. U.S. Pat. No. 4,370,788, issued to Baker on Feb. 1, 1983, discloses a method of aligning a cylindrical bore of an internal combustion engine and includes the provision of a strip of material having free ends and which is formed into a hoop which is subjected to hoop stress.

U.S. Pat. No. 3,094,773, issued to Bukoff on Jul. 25, 1963, is directed to a process for installing sleeves in the cylinder bore of a fluid motor such as found in the aircraft wheel and brake art and includes machining the bore at one end with a recess to receive a shoulder which has been formed on an end of the liner.

U.S. Pat. No. 2,412,587, issued to Larson on Dec. 17, 1946, is directed to hydraulic brake systems on motor vehicles and particularly to the master and wheel cylinders of the vehicles. The patent is specifically directed to means for removably holding the sleeve in place in the cylinder bore.

None of the above patents are directed to a modular fluid actuator wherein the actuator body is comprised of a plurality of body members having a bore of predetermined diameter therein and wherein the modular body members are secured in abutting, serial relation, and a single common liner is carried in the bores of the body members.

SUMMARY OF THE INVENTION

It is an object of the present invention, therefore, to provide a fluid actuator which may be installed in a system in a rapid and facile manner.

It is a further object of the present invention to provide such a fluid actuator which is constructed in a modular fashion.

It is still a further object of the present invention to provide such a modular fluid actuator with a configuration in which the possibilities of leakage between the modules are eliminated.

DESCRIPTION OF THE PREFERRED EMBODIMENT

Figure 1:
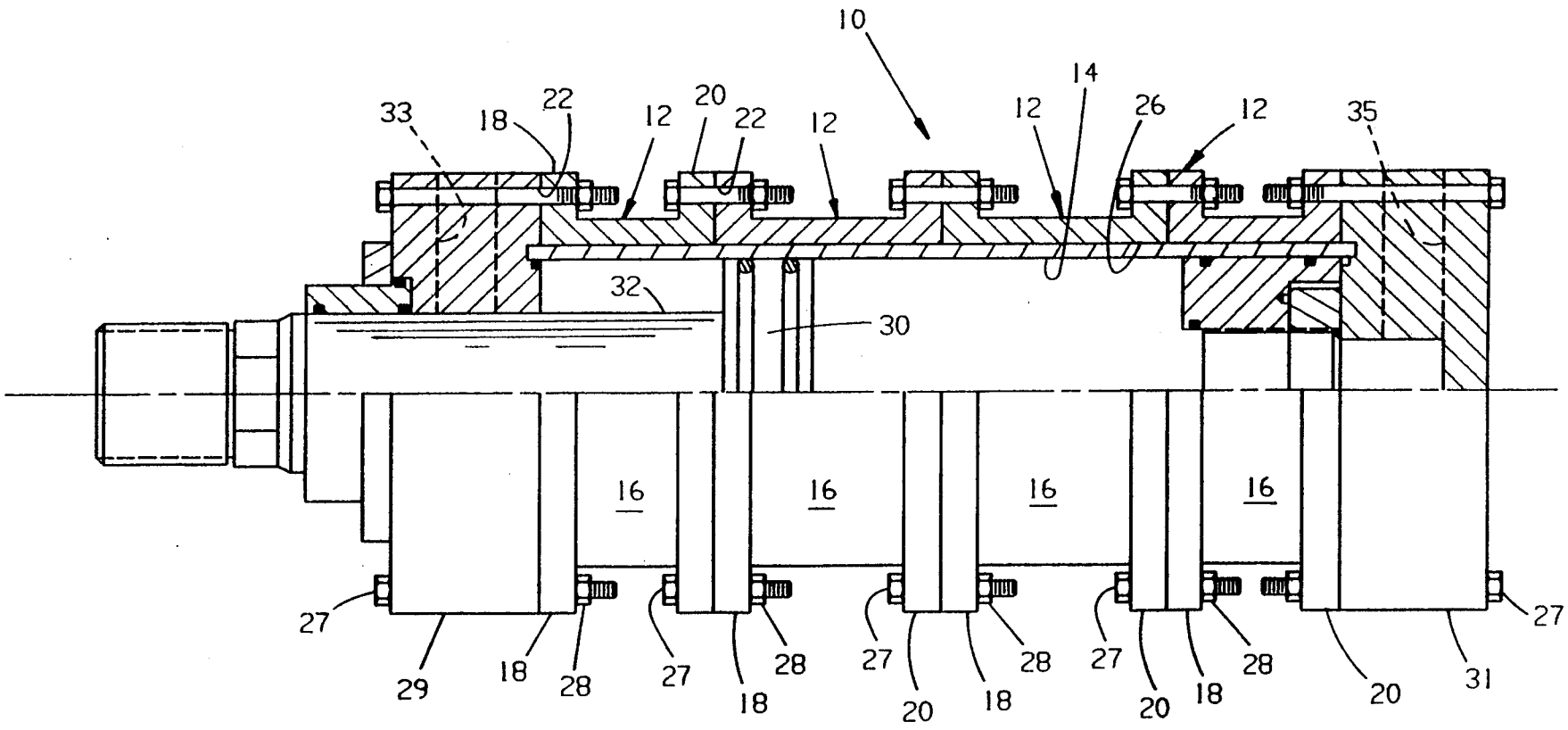
FIG. 1 is an elevational view, partially in section, of an embodiment of the present invention wherein a plurality of modules are arranged in serial relation with nuts and bolts provided for individually securing flanges of each module to flanges of adjacent modules. A piston having a single piston rod associated therewith is mounted in a continuous liner which extends through adjacent modules.

As seen in FIG. 1, a modular fluid actuator 10 is shown to include a plurality of modules 12 secured around a single cylindrical liner 14. Each module in this embodiment includes a body 16 having flanges 18 and 20 at the end thereof, and each flange is provided with a plurality of bolt openings 22 arranged in a bolt circle on the flanges.

Each module body is provided with a bore 26 therethrough to receive liner 14 therein. The liner is fitted in the bores and extends through the bores of the serially connected modules.

In the embodiment of the present invention illustrated in FIG. 1, each module is secured to the adjacent module of the serially arranged modules by bolts 27 and nuts 28, thereby making up a unitary structure in which a piston and piston rod (or rods) may be mounted. In the embodiment of FIG. 1, a single piston 30 and rod 32 are shown mounted in the assembly as an example. The modular assembly also includes a pair of end caps 29 and 31 having fluid passages 33 and 35 provided therein. The fluid passages are disposed for communication with a source of fluid pressure and with the interior of the liner to direct fluid to and from the opposite face surfaces of piston 30 for movement thereof in the actuator assembly.

Figure 2:
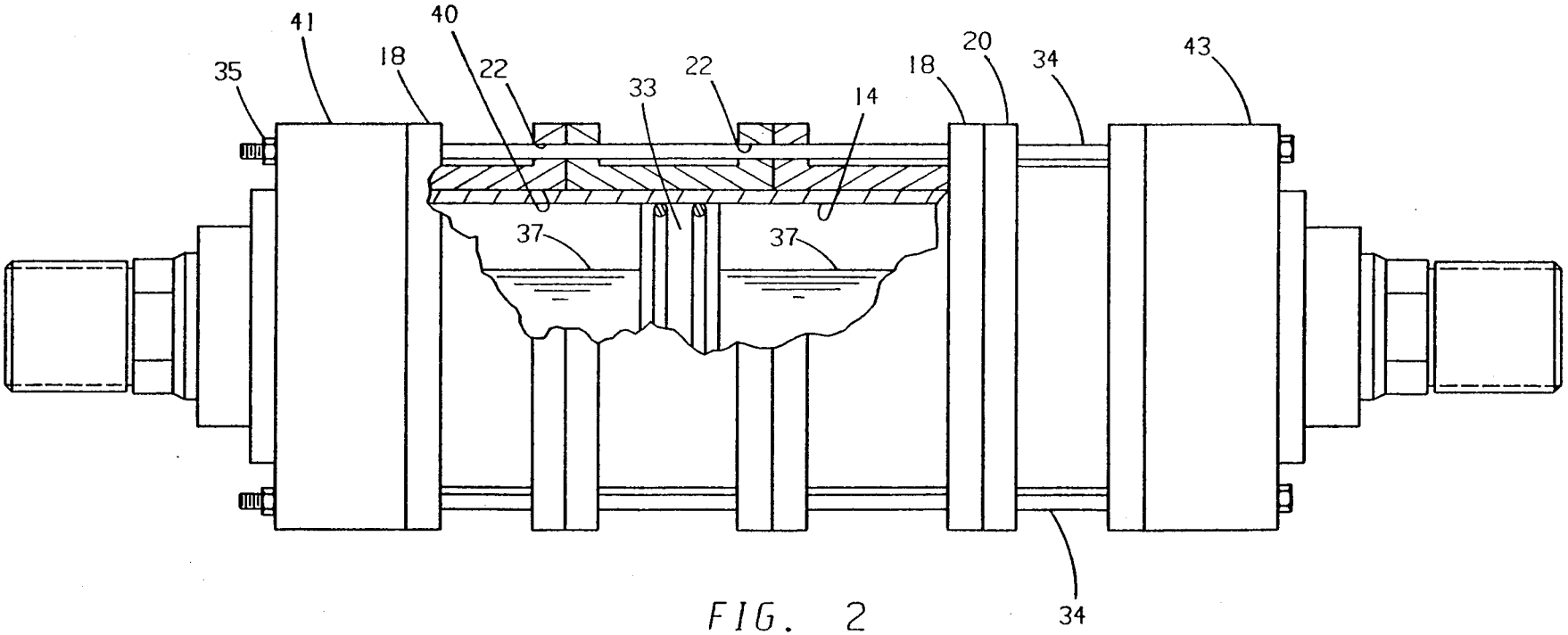
FIG. 2 is an elevational view, partially in section, of a plurality of modules arranged as in FIG. 1. A single piston is shown to be provided with a pair of piston rods extending therefrom. The modules are secured together by long threaded shafts which extend through the modules and are secured to the ends thereof by nuts.

FIG. 2 illustrates an actuator similar to FIG. 1 wherein the modules are serially arranged and are secured together by a plurality of threaded rods 34 which are common to each module and which extend through bolt openings 22 of flanges 18 and 20 of each of the modules and is secured by a nut 35 to retain the modules in serial arrangement. FIG. 2 further illustrates the single liner 14 extending through the adjacent modules, and a piston 33 and a pair of piston rods 37 are mounted in the assembly. The modular assembly also includes a pair of end caps 41 and 43 having fluid passages (not shown) but which are similar to those illustrated in FIG. 1. The fluid passages are disposed for communication with a source of fluid pressure and with the interior of the liner to direct fluid to and from the opposite face surfaces of piston 33 for movement thereof in the actuator assembly.

Figure 3:
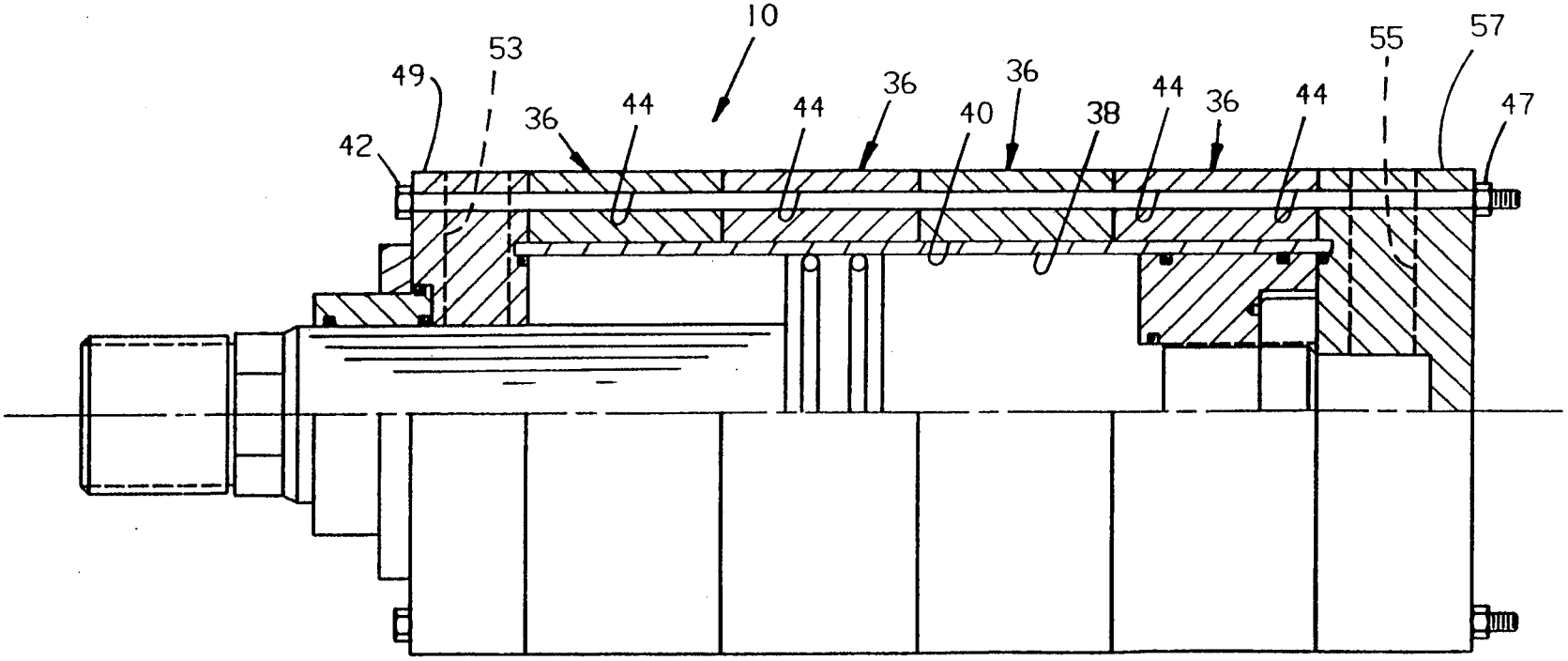
FIG. 3 is an elevational view, partially in section, of an embodiment of a fluid actuator of the present invention which is arranged in a modular configuration as in FIGS. 1 and 2. However, in this embodiment, flanges are not provided on each module. The modules are held together by threaded rods which extend through a plurality of aligned openings of each module. A piston and a single rod are shown mounted in the assembly.

FIG. 3 is an embodiment of a modular fluid actuator which is made up of a plurality of serially arranged module members 36 in secured relation. A single liner 38 is supported in a bore 40 of each of the modules and extends the length of the assembled modules. A plurality of threaded rods 42 extend through bolt openings 44 for secured relation by nuts 47. In this embodiment, no flanges are provided on the modules, and each module 36 is provided with a predetermined external shape and dimension (rectangular, circular, etc.). The body is bored to a predetermined diameter to form bore 40 which receives liner 38 therein. A piston and piston rod similar to that shown in FIG. 1 are provided for reciprocal movement in the liner. The modular assembly also includes a pair of end caps 49 and 57 having fluid passages 53 and 55 provided therein. The fluid passages are disposed for communication with a source of fluid pressure and with the interior of the liner to direct fluid to and from the opposite face surfaces of the piston for movement thereof in the actuator assembly.

It is to be understood that the sleeve may be retained in the bores of the modules by any of various methods. One manner in which the sleeves may be mounted is by a friction fit between the module bore and the sleeve. A second approach (as shown in FIG. 6) to retaining the sleeve in the modules is to provide an annular groove 50 in the distal end 52 of each end module of the unitary assembly and to crimp the ends 53 of the sleeve into annular grooves 50. Still another method of securing the sleeve in the modules is to provide the end modules of the module assembly with cover members 54 which are secured to the end modules of the assembly (FIG. 5) in abutting relation with the ends 56 of the sleeve. The liners may be fitted in the bore in this embodiment, with clearance fit. Any of many other means may be resorted to, if desired.

Figure 8:
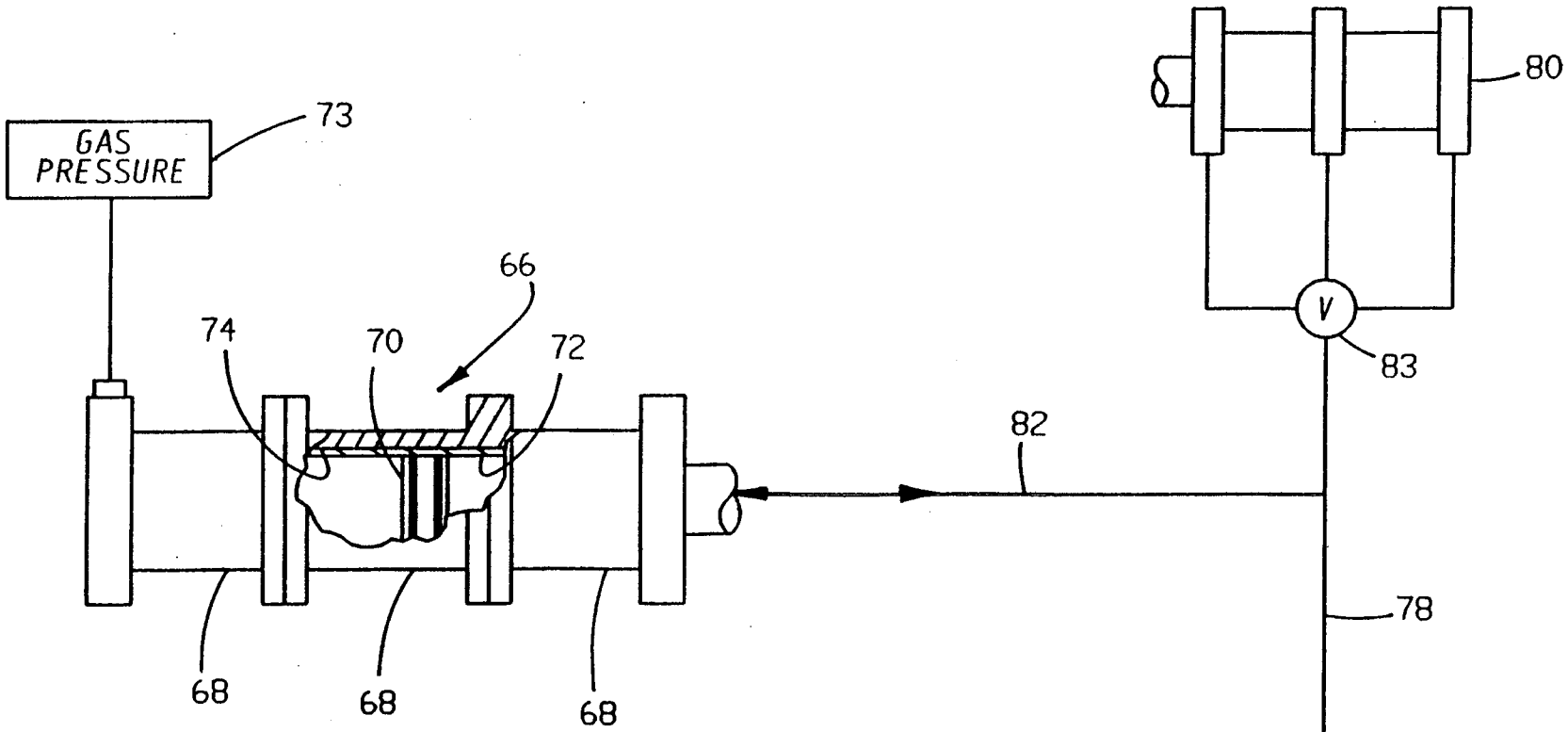
FIG. 8 is a diagrammatic view of an embodiment of the present invention wherein the principles of the present invention are incorporated in a fluid system using an accumulator.

FIG. 8 illustrates the principles of the present invention applied to a fluid system using an accumulator 66. The accumulator is shown to be made up of a plurality of modules 68 assembled as described above. A free-floating piston 70 is mounted in a liner 72 carried in bores 74 of the modules of the accumulator 66. As shown in FIG. 8, a source of gas 74 directs gas pressure into the accumulator body (made up of modules 68) for movement of piston 70. A pump 76 is secured in a line 78 to deliver fluid under pressure into accumulator 66 and to a fluid actuator 80. A separate line 82 directs fluid into accumulator 66. The gas pressure on piston 66 forces fluid from accumulator 66 through a valve 83 into actuator 80 to maintain constant fluid pressure in actuator 80.

Figure 5:
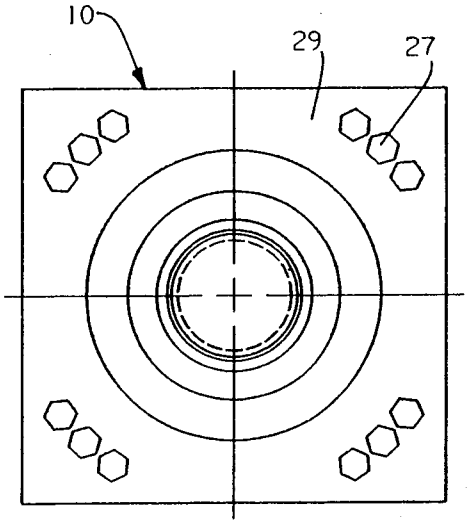
FIG. 5 is an end elevational view of an actuator body having a rectangular cross-sectional configuration.
Figure 7:
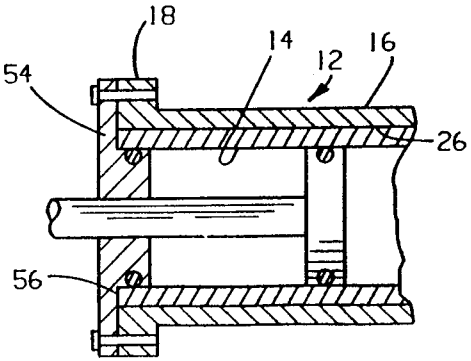
FIGS. 6 and 7 are fragmentary elevational sectional views of different ways in which the sleeve may be retained in the cylinder bore.
Figure 4:
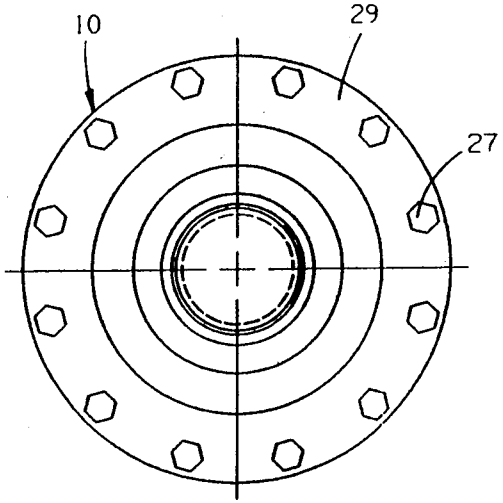
FIG. 4 is an end view of an actuator body having a circular cross-sectional configuration.
Figure 6:
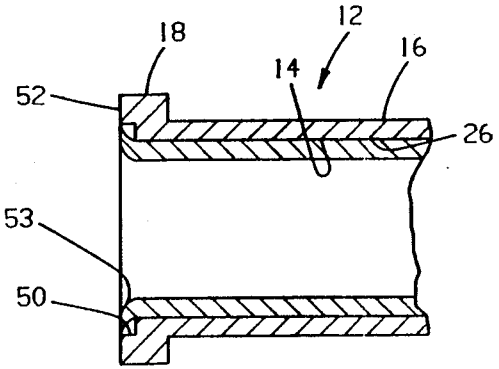

FIGS. 4 and 5 are end elevational views of an actuator illustrating an actuator respectively having a circular and square cross-sectional configuration. It is to be understood that the actuator bodies of any of the embodiments of the present invention may be provided with either of the external shapes as shown in FIGS. 4 and 5. Alternatively, other external configurations may be resorted to if desired.

It is to be understood that the liner of the present invention may be made of any of various types of material, such as steel, brass, etc. The liner material is chosen for the particular environment in which it is to be used. For example, oil or emulsion may be the medium which is used in the actuator assembly, and the liner, therefore, is made of a material which is compatible with oil or emulsion or with any other medium used. Also, the inner surface of the liner may be chrome coated, if desired.

It is to be further understood that while various embodiments of the invention are specifically disclosed herein, other modifications may be resorted to that are within the spirit and scope of the following claims.

It is to be understood that the modular concept of the present invention is applicable to both large and small actuators; however, the concept is particularly applicable to large actuators which would be difficult, time-consuming, and expensive to rebore.

Applicant's inventive concept includes the provision of modular actuators having a replaceable liner which, along with the appropriate piston seals, etc., may be made available in kit form which may be carried in stock or ordered. To repair the modular assembly, it is only necessary to briefly shut down the system, disassemble the module, remove and replace the defective liner and seals with the parts available in the kit, and reassemble and replace the modular actuator in the system.

I claim:

1. A modular fluid actuator assembly comprising:

a housing formed by a single plurality of serially arranged bodies including first and second end bodies, each of said plurality of said bodies having a bore therein for substantially aligned relation responsive to positioning of said bodies in said serial arrangement;

a single cylindrical liner, said single cylindrical liner being removably mounted in said bore of each body of said serially arranged bodies;

piston means mounted in said cylindrical liner for reciprocal movement therein;

said cylindrical liner having first and second end surfaces, said cylindrical liner extending through said bodies for abutting relation of said first and second end surfaces, respectively, with said first and second end body members, whereby said cylindrical liner is secured against axial movement in said bores of said serially arranged bodies as a result of the reciprocal movement of said piston in said sleeve; and securing means for securing said bodies in said serial relation.

2. Apparatus as set forth in claim 1 wherein each body of said plurality of bodies includes a plurality of longitudinal holes therethrough, and securing means extending through said holes for securing said bodies in said serial relation.

3. Apparatus as set forth in claim 2 wherein said means extending through said holes is a bolt, said bolt disposed for receiving a nut means thereon.

4. Apparatus as set forth in claim 3 wherein each said body is provided with a flange on opposite ends thereof and wherein said flange of each said body is disposed for abutting relation with a flange on the adjacent said body to effect said serial relation.

5. Apparatus as set forth in claim 3 wherein each said body is provided with a pair of spaced substantially parallel end surfaces and wherein said end surface of each said body is disposed for abutting relation with an end surface of the adjacent said body to effect the serial mating relation of said bodies.

6. Apparatus as set forth in claim 4 wherein said securing means extending through said holes is a threaded member extending through said holes of said flanges of only the adjacent mating flanges of said bodies, and said nut means for threaded engagement on said threaded member.

7. Apparatus as set forth in claim 4 wherein said securing means extending through said holes is a threaded member extending through holes of said flanges of all of said plurality of flanges, and nut means for threaded engagement on said threaded member.

8. A modular fluid actuator assembly comprising:

a housing defined by a single plurality of adjacently disposed, serially arranged bodies including first and second end body members respectively disposed at opposite ends of said serially arranged bodies, said serially arranged bodies and at least one of said first and second end body members having a bore therethrough in aligned relation;

a single cylindrical liner having internal and external surfaces, said cylindrical liner mounted in said bores of each of said bodies with said external surface in contactual relation with the internal surfaces of said bores of said serially arranged single plurality of bodies, whereby said cylindrical liner is directly supported by said bodies, said cylindrical liner being completely contained between said end body members;

piston means mounted for reciprocal movement in said liner, said piston means including a piston member having opposite face surfaces and a piston rod secured to and extending from one of said opposite face surfaces and through said bore of said at least one of said first and second end members;

passage means including a pair of passages, each respectively communicating into said liner and with said opposite face surfaces of said piston member, said passage means adapted to receive fluid from a source of fluid and for directing said fluid to said opposite face surfaces of said piston for reciprocal movement thereof in said liner; and securing means for removably securing said bodies including said body members in serial relation.

9. A fluid actuator as set forth in claim 8 wherein said cylindrical liner is a tubular member.

10. A fluid actuator as set forth in claim 9 wherein said tubular member extends into and is common to each body of said plurality of bodies.

11. A fluid actuator as set forth in claim 10 wherein a pair of said serially arranged bodies is provided with outwardly facing end surfaces and an end cap secured to each said outwardly facing end surface, each said end cap having a said passage of said passage means extending therethrough in communication with the interior of said liner means.

12. A fluid actuator assembly as set forth in claim 11 wherein said bodies are provided with a circular cross-sectional configuration.

13. A fluid actuator as set forth in claim 10 including means for removably securing said liner in said bodies.

14. A fluid actuator as set forth in claim 13 wherein said means for removably securing said liner in said bodies is defined by a friction fit of said liner in said bodies.

15. A fluid actuator as set forth in claim 13 wherein said means for removably securing said liner in said bodies is defined by providing said end caps in abutting relation with respective opposite ends of said liner.

16. A modular fluid actuator assembly comprising:

a housing defined by a single plurality of adjacently disposed, serially arranged bodies including first and second end body members having inner and outer surfaces, said end body members respectively disposed at opposite ends of said serially arranged bodies with said inner surfaces in contact with an adjacent one of said serially arranged bodies, said serially arranged bodies and at least one of said first and second end body members having a bore therethrough in aligned relation;

a single cylindrical liner having first and second ends and internal and external surfaces, said cylindrical liner mounted in said bores of each of said bodies with said external surface in contactual relation with the internal surfaces of said bores of said serially arranged single plurality of bodies, whereby said cylindrical liner is directly supported by said bodies, said cylindrical liner being completely contained between said end body members;

piston means mounted for reciprocal movement in said liner, said piston means including a piston member having opposite face surfaces and a piston rod secured to and extending from one of said opposite face surfaces and through said bore of said at least one of said first and second end members;

passage means including a pair of passages, each respectively communicating into said liner and with said opposite face surfaces of said piston member, said passage means adapted to receive fluid from a source of fluid and for directing said fluid to said opposite face surface of said piston for reciprocal movement thereof in said liner;

first securing means disposed on said first and second ends of said liner for securing said liner in said bodies and preventing axial movement of said liner responsive to reciprocal movement of said piston in said liner; and second securing means for removably securing said bodies including said body members in serial relation.

17. Apparatus as set forth in claim 16 wherein said first securing means means is defined by an abutting relation of said first and second ends of said liner, respectively, with said internal surfaces of said first and second end body members.

* * * * *